United States Patent [19]

Shiokawa

[11] 4,018,150

[45] Apr. 19, 1977

[54] OPEN-SIDED PRESS

[76] Inventor: Seiji Shiokawa, 110-6 Matsumoto, Mishima, Shizuoka, Japan

[22] Filed: June 11, 1975

[21] Appl. No.: 585,803

[52] U.S. Cl. ..... 100/231; 100/269 R

[51] Int. Cl.[2] ..... B30B 1/32

[58] Field of Search ..... 100/214, 269 R, 231; 72/455

[56] References Cited

UNITED STATES PATENTS

| | | | |
|---|---|---|---|
| 2,296,051 | 9/1942 | Pocock | 100/231 |
| 2,580,078 | 12/1951 | Denison | 100/231 |
| 3,247,783 | 4/1966 | Hammon | 100/231 |
| 3,303,774 | 2/1967 | Shiokawa | 100/269 R X |
| 3,561,252 | 2/1971 | Norton et al. | 100/231 X |

*Primary Examiner*—Billy J. Wilhite
*Attorney, Agent, or Firm*—Kurt Kelman

[57] ABSTRACT

In a press which comprises an upper frame provided at the forward end thereof with a main cylinder, a lower frame opposed to said upper frame across a vertical spacing and a shank frame attached integrally to the ends of said upper and lower frames so as to provide support therefor and which is adapted to produce pressure for required fabrication by hydraulically actuating said main cylinder, an auxiliary cylinder is incorporated parallel to the main cylinder of the upper frame between the main cylinder and the shank frame and the forward end of the piston of said auxiliary cylinder is fastened onto the lower frame by the medium of a tension bar. The hydraulic actuating fluid is delivered to the auxiliary cylinder through a flow path which branches off from the flow path of said hydraulic fluid to the main cylinder, and the direction in which said fluid is delivered to the auxiliary cylinder is opposite that in which the fluid flows to the main cylinder. When the hydraulic actuating fluid is delivered to the main cylinder to produce pressure for required fabrication, the fluid is simultaneously delivered to the auxiliary cylinder to push up the auxiliary cylinder. This elevation of the auxiliary cylinder serves the purpose of producing a corrective action to minimize possible deflection, i.e. divergence of the forward ends of the upper and lower frames caused by the pressing force generated at the anvil, making it possible to enhance the precision with which desired fabrication by pressing is accomplished.

3 Claims, 3 Drawing Figures

OPEN-SIDED PRESS

BACKGROUND OF THE INVENTION

This invention relates to improvements in an open-sided press. More particularly, this invention relates to an unusually light and highly useful open-sided press which incorporates an extremely simple mechanism capable of correcting possible deflection produced in the frames at the time of pressing, whereby otherwise possible deviation of the centers of the upper and lower anvils is precluded and, at the same time, the load applied to the tension plate is lessened.

Generally in an open-sided press, an upper frame and a lower frame are attached, in the manner of arms to a shank frame and a hydraulic cylinder is incorporated at the forward end of said upper frame and a table is disposed on the upper side at the forward end of the lower frame, so that an upper and a lower anvil may be attached respectively to the lower end of the rod of the cylinder and to the upper surface of the table. During the work of pressing, therefore, the pressing force produced between the anvils gives birth to repulsive force which acts on the upper and lower frames and the shank frame to cause these frames to deflect divergently in the form of a bow. Since this deflection is such that the centers of the anvils will deviate, the press system of this construction is not suitable for pressing work of exacting precision.

The invention (U.S. Pat. No. 3,303,774) completed by the present inventor has already introduced means for the correction of such deflection to the art.

The invention mentioned above is directed to giving the open-sided press a corrective mechanism, such that an auxiliary cylinder incorporated therein produces deflection in the direction opposite that of the deflection which occurs in the frames at the time of pressing and the magnitude of the opposing deflection caused by the auxiliary cylinder equals or surpasses that of the deflection in the frames. Therefore, the deflection which occurs at the time of pressing is offset by causing the auxiliary cylinder to produce a deflection in the opposite direction. In actuality, the deflection which the main cylinder produces at the forward ends of the upper and lower frames is offset by the deflection which the auxiliary cylinder produces in the opposite direction at said forward ends and, therefore, is prevented from manifesting its effect upon the operation of pressing. Nevertheless, this invention cannot prevent the deflection itself from occurring.

Furthermore the shank frame must withstand the tension resulting from the combining of the repulsive tension produced at the time of pressing and the tension produced by the auxiliary cylinder and, therefore, requires strength which can be obtained only by use of steel plate of sufficient thickness. Thus, it is not possible to reduce the weight of the unit by reducing the weight of the shank frame.

One object of the present invention is to provide an open-sided press which makes it possible to accomplish the desired fabrication by pressing with high precision and perfect freedom from the deflection which would otherwise occur at the time of pressing.

Another object of the present invention is to provide an open-sided press which is light in weight and simple in construction.

SUMMARY OF THE INVENTION

To accomplish the objects mentioned above with respect to a press which comprises an upper frame provided at the forward end thereof with a main cylinder, a lower frame opposed to said upper frame across a vertical spacing and a shank frame attached integrally to the basal ends of said upper and lower frames so as to provide support therefor and which is adapted to produce pressure for required fabrication by hydraulically actuating said main cylinder, the present invention provides said press with a corrective mechanism which comprises an auxiliary cylinder disposed parallel to the main cylinder of the upper frame between said main cylinder and the shank frame, a piston rod projected from the forward end of said auxiliary cylinder and fastened onto the lower frame by the medium of a tension bar, and flow path means adapted to deliver the hydraulic actuating fluid to the auxiliary cylinder in a direction opposite that of the fluid in the flow path to the main cylinder and enable the auxiliary cylinder to produce pressure greater than that produced by the main cylinder.

When the hydraulic actuating fluid is delivered to the main cylinder for the purpose of fabrication by pressing, therefore, said fluid is simultaneously forced upwardly into the auxiliary cylinder, with the result that the resultant elevation of the auxiliary cylinder serves the purpose a corrective action to minimize deflection in the form of mutual divergence of the forward ends of the ends of the upper and lower frames. Consequently, the open-sided press can accomplish desired fabrication by pressing with enhanced precision. Since the shank frame is no longer exposed to any tensile force, it requires no reinforcement and, therefore, can be reduced in weight. The aforementioned corrective mechanism is extremely simple and can easily be incorporated into any of the conventional press.

The other objects and characteristic features of the present invention will become apparent from the description to be given in further detail herein below with reference to the attached drawings.

DETAILED DESCRIPTION OF THE INVENTION

Figure 1:
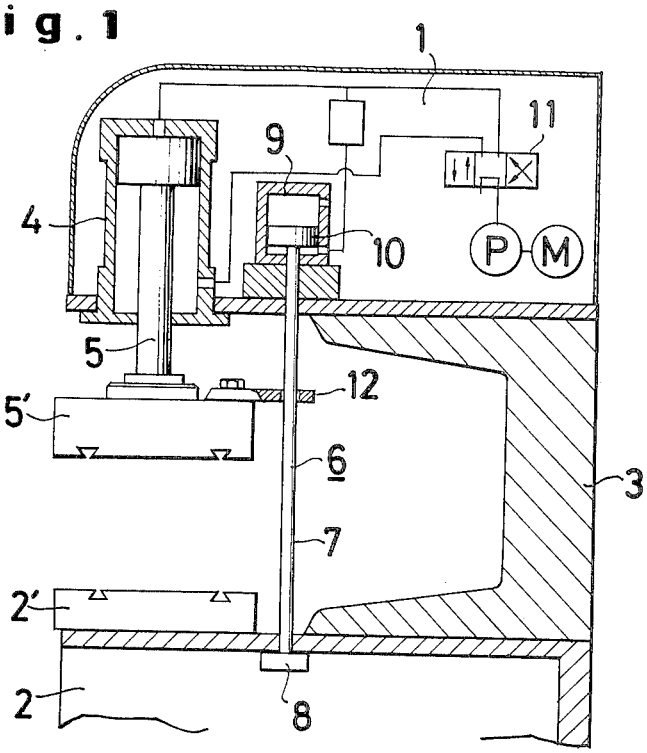
FIG. 1 is a cross-sectional side elevation illustrating one preferred embodiment of the open-sided press according to the present invention.

With reference to FIG. 1, an upper frame 1 is projected from the upper end of a shank frame 3 and a lower frame 2 is projected correspondingly to said upper frame from the lower end of said shank frame, both in the manner of extending arms. To the forward end of the upper frame 1, a main cylinder 4 is fastened in such way that a piston rod 5 protrudes downwardly. At its lower end, said piston rod 5 is provided with a base 5′ adapted to permit attachment of an upper anvil (not illustrated). Also at the forward end of the lower frame 2, there is disposed a base 2′ adapted to permit attachment of a corresponding lower anvil (not illustrated).

A work blank to be fabricated by pressing is placed on the lower anvil. When the hydraulic actuating fluid is delivered via the directional control valve to the main cylinder, the upper and lower anvils are brought into engagement to compress the work. At this moment, the pressing force exerted by the rod 5 is transmitted in the form of reactional force to the upper frame 1, the lower frame 2 and the shank frame 3 giving rise to deflection tending to diverge the forward ends of the upper and lower frames. When such deflection occurs, it displaces the upper and lower anvils so that the work of pressing can no longer be carried out with precision.

With a view to precluding the deflection which occurs in the upper and lower frames at the time of pressing, the present invention has a correcting mechanism 6 incorporated between the shank frame 3 and the main cylinder 4. To be more specific, an auxiliary cylinder 9 is disposed in the upper frame 1 at a position intervening between the shank frame 3 and the main cylinder 4, with the piston rod 10 of said auxiliary cylinder 9 projected downwardly to form a tension bar 7. The lower end 8 of this tension bar 7 is fastened to the lower frame 2. The flow path of the hydraulic actuating fluid for the main cylinder 4 is branched off, and the branch flow path is extended and connected to the lower portion of the auxiliary cylinder 9.

When the hydraulic actuating fluid is delivered to the main cylinder to produce pressure for required fabrication, said fluid is simultaneously delivered to the lower portion of the auxiliary cylinder 9. While the piston rod 5 consequently descends, the piston 10 is elevated to impart an upward tensile force to the tension bar 7. As a result, the tension bar 7 which has its lower end attached to the lower frame 2 and its upper end connected to the piston 10 of the auxiliary cylinder 9 draws the upper frame and the lower frame toward each other and prevents them from yielding to said deflection. The pressing force generated at the time of pressing between the upper anvil and the lower anvil originates in the pressure exerted on the piston rod 5, which pressure is determined by the pressure of the hydraulic actuating fluid being delivered to the main cylinder.

Figure 2:
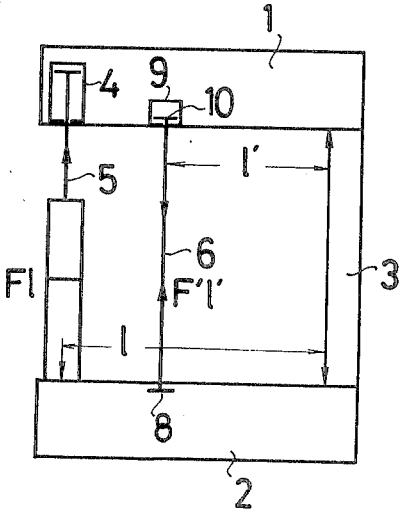
FIG. 2 is an explanatory diagram showing the operating principle of the present invention.

Since the upper frame 1, the lower frame 2 and the shank frame 3 are deflected owing to the pressing force generated by the anvils, it is imperative that the moment, $Fl$, due to the reactional force tending to deflect the frames be equal to or smaller than the moment, $F'l'$, being applied to the tension bar 7, wherein F stands for the reactional force caused at the piston rod, $F'$ for the tensile force caused at the tension bar, $l$ for the distance between the main cylinder and the shank frame and $l'$ for the distance between the tension bar and the shank frame. In other words, with reference to the diagram of FIG. 2, if the moment $Fl$ of the reactional force generated between the upper and lower anvils is greater than the moment $F'l'$ in the tension bar 7, then the frames experience deflection which is proportional to the difference between the two moments. In order that the entire press system is so constructed as to preclude the frames from such deflection, the relationship expressed by formula (1) given below should be satisfied.

$$Fl \leqq F'l' \ldots \quad (1)$$

The tension bar 7 is interposed between the shank frame 3 serving to support the upper and lower frames in position and the main cylinder 4. It follows that the distance $l'$ from the shank frame 3 to the tension bar 7 is smaller than the distance $l$ from the shank frame 3 to the main cylinder 4.

For formula (1) to be satisfied, therefore, the relationship of the formula (2) should required by all means.

$$F < F' \ldots \quad (2)$$

In this formula, F is the product of ps and $F'$ is the product of $p's'$, wherein $p$ stands for the inner pressure exerted on the main cylinder, $p'$ for the inner pressure exerted on the auxiliary cylinder, $s$ for the pressing area of the main cylinder and $s'$ for the pressing area of the auxiliary cylinder.

Figure 3:
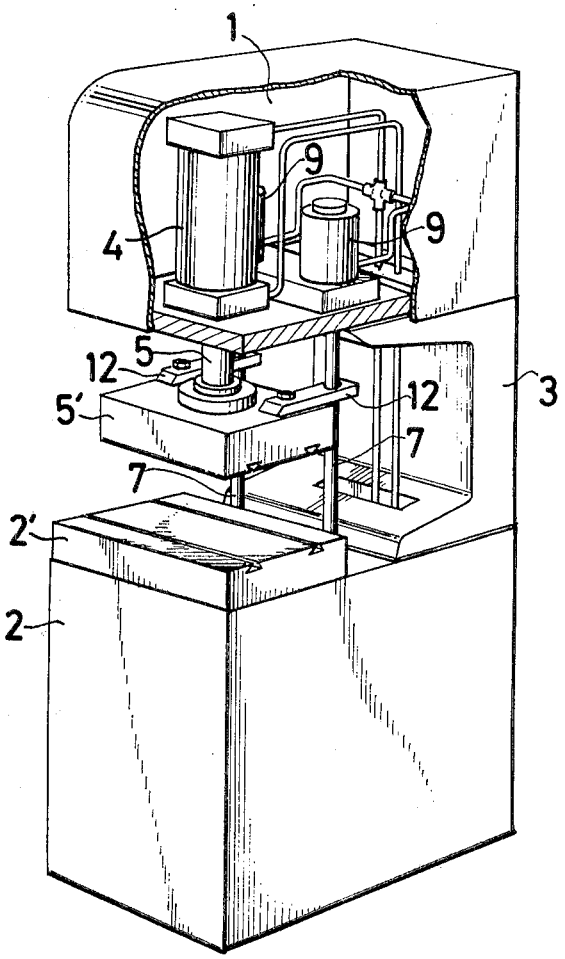
FIG. 3 is a perspective partially cutaway view illustrating another preferred embodiment of the open-sided press according to the present invention.

Equation of the two inner pressures, $p = p'$, occurs when the flow path of the hydraulic actuating fluid for the main cylinder is branched off without modification and extended to the auxiliary cylinder 9. In this case, therefore, the expression (2) is satisfied when the pressing area $s'$ inside the auxiliary cylinder 9 is greater than the pressing area $s$ inside the main cylinder 4. To meet the conditions described above, it is necessary to give a greater diameter to the auxiliary cylinder 9 then to the main cylinder 4 or to incorporate a plurality of auxiliary cylinders 9 and tension bars 7 (as shown in FIG. 3) so that the combined pressing area within these auxiliary cylinders will be greater than the pressing area within the main cylinder. FIG. 3 illustrates an embodiment of the press incorporating two auxiliary cylinders. Two arms 12 are fastened at their respective basal ends to the base 5' and are pierced at the other ends by perforations, one for each arm, to pass tension bars 7. These tension bars, therefore, function concurrently as guides for the vertical movement of the rod of the main cylinder.

In the case of a press system so constructed that the pressing area within the auxiliary cylinder 9 cannot be increased to exceed the pressing area within the main cylinder, the expression (2) can alternatively be satisfied as by inserting a pressure-increasing mechanism in the flow path of the hydraulic actuating fluid for the auxiliary cylinder so as to increase the pressure of the hydraulic actuating fluid delivered to the auxiliary cylinder enough to satisfy the relationship of $p<p'$.

When the main cylinder is relieved of the hydraulic pressure after required generation of pressure for fabrication is completed, the interior of the auxiliary cylinder is similarly relieved of pressure. Consequently, the tensile force ceases to exist in the tension bar 7.

According to the present invention, the deflection which occurs in the frames at the time of pressing is overcome by virtue of the moment generated in the opposing direction by the tensile force which is produced thanks to the flow path branched off from the flow path of the hydraulic actuating fluid for the main cylinder as described in detail above. Thus, the upper and lower frames and the shank frame are prevented from yielding to said deflection. Even if the pressure produced for the work of pressing is increased, the opposing moment due to the tensile force is proportionally increased. The prevention of the frames from the deflection, therefore, can be ensured without reference to the magnitude of the pressure being used for the work of pressing.

Since the tension bar is exposed only to a tensile force which is equal to or but slightly larger than the reactional force generated at the time of pressing, it requires only the strength of a metal bar of a small diameter. And the shank frame which supports the upper frame and the lower frame is only exposed to the compressive load corresponding to the difference, $F' - F$, at the time of pressing, it will require no great strength but will require only the strength of a thin-walled material. Thus, the present invention can be utilized advantageously for small press systems. It can of course be applied to large mechanical arrangements intended to prevent occurrence of deflection. Furthermore, since the corrective mechanism according to the present invention is extremely simple in its working principle, it can easily be incorporated into conventional press systems.

What is claimed is:

1. In an open-sided press which comprises an upper frame having a rear and a forward end, a main cylinder at the forward end, a lower frame having a rear end, the lower frame being opposed to said upper frame across a vertical spacing, and a shank frame attached integrally to the rear ends of said upper and lower frames so as to provide support therefor, the press being adapted to produce pressure by hydraulically actuating said main cylinder, the improvement wherein said open-sided press further comprises a corrective mechanism having an auxiliary cylinder means including at least one auxiliary cylinder disposed parallel to the main cylinder of the upper frame between said main cylinder and the shank frame, a rod projected from the forward end of each auxiliary cylinder and forming a tension bar fastened onto the lowerframe, and flow path means adapted to deliver the hydraulic actuating fluid to the auxiliary cylinder means in a direction opposite that of the fluid in the flow path to the main cylinder.

2. The open-sided press according to claim 1, wherein the pressing area within the auxiliary cylinder means is greater than the pressing area within the main cylinder.

3. The open-sided press according to claim 1, wherein the auxiliary cylinder means includes a plurality of auxiliary cylinders so that the combined pressing area within said plurality of auxiliary cylinders is greater than the pressing area within the main cylinder.

* * * * *